US008186116B2

(12) United States Patent
Anderson

(10) Patent No.: US 8,186,116 B2
(45) Date of Patent: May 29, 2012

(54) TILE TRAY

(75) Inventor: Gordon Anderson, New South Wales (AU)

(73) Assignee: Unika (Australia) Pty Limited, New South Wales (AU)

( * ) Notice: Subject to any disclaimer, the term of this patent is extended or adjusted under 35 U.S.C. 154(b) by 34 days.

(21) Appl. No.: 12/740,637

(22) PCT Filed: Oct. 30, 2008

(86) PCT No.: PCT/AU2008/001603

§ 371 (c)(1),
(2), (4) Date: Apr. 29, 2010

(87) PCT Pub. No.: WO2009/055852

PCT Pub. Date: May 7, 2009

(65) Prior Publication Data

US 2010/0257801 A1 Oct. 14, 2010

(30) Foreign Application Priority Data

Oct. 30, 2007 (AU) ..... 2007905945
Mar. 26, 2008 (AU) ..... 2008902627

(51) Int. Cl.
*E04F 13/08* (2006.01)

(52) U.S. Cl. ..... 52/392; 52/181; 52/387; 52/388; 52/592.1

(58) Field of Classification Search ..... 52/384, 52/387, 388, 177, 181, 392, 476, 477, 592.1, 52/591.1, 676, 573.1, 396.1
See application file for complete search history.

(56) References Cited

U.S. PATENT DOCUMENTS 5,323,575 A 6/1994 Yeh
5,477,643 A * 12/1995 Koenig, Jr. ..... 52/100
5,616,389 A * 4/1997 Blatz ..... 428/45
6,467,224 B1 10/2002 Bertolini
7,487,622 B2 * 2/2009 Wang ..... 52/384
7,610,731 B1 * 11/2009 Collison ..... 52/591.3
7,698,859 B2 * 4/2010 Sansano Marti ..... 52/177
7,757,449 B2 * 7/2010 Portoles Ibanez et al. ..... 52/384
2003/0089051 A1 * 5/2003 Bertolini ..... 52/177
2003/0136070 A1 * 7/2003 Ku ..... 52/403.1
2004/0123538 A1 * 7/2004 Ko ..... 52/385
2005/0214077 A1 9/2005 DeArmond, Jr.
2005/0223666 A1 * 10/2005 Forster et al. ..... 52/392

(Continued)

FOREIGN PATENT DOCUMENTS

CN 2213192 Y 11/1995
DE 9006046 U1 8/1990
GB 2134944 A 8/1984

(Continued)

OTHER PUBLICATIONS

Chinese Office Action; Sep. 2, 2010; Application No. 2010083000535190.

(Continued)

*Primary Examiner* — William Gilbert
*Assistant Examiner* — Brian D Mattei
(74) *Attorney, Agent, or Firm* — Knobbe, Martens Olson & Bear LLP

(57) ABSTRACT

A tile tray (1) including a generally planar base (2) and two or more retaining members (5) adapted to locate and retain a tile (7) to the base. The tile tray (1) further includes a coupling means for connecting two or more of the tile trays in a substantially aligned configuration.

27 Claims, 10 Drawing Sheets

U.S. PATENT DOCUMENTS

| | | | | |
|---|---|---|---|---|
| 2006/0032169 | A1 | 2/2006 | Mei | |
| 2006/0260223 | A1* | 11/2006 | Wang | 52/177 |
| 2007/0022693 | A1* | 2/2007 | Ran | 52/578 |
| 2007/0094969 | A1* | 5/2007 | McIntosh et al. | 52/386 |
| 2007/0193133 | A1* | 8/2007 | Krupnick | 52/177 |

OTHER PUBLICATIONS

Australian Patent Office International-Type Search Report; Application No. 2008902627; Filed Mar. 26, 2008.

* cited by examiner

TILE TRAY

FIELD OF THE INVENTION

The present invention relates generally to modular floor and wall covering systems and, in particular, to tiled wall and floor covering systems.

The invention has been developed primarily as a tile tray for use with tiles and pavers and will be described hereinafter with reference to this application. However, it will be appreciated that the invention is not limited to this particular field of use.

BACKGROUND OF THE INVENTION

The following discussion of the prior art is intended to place the invention in an appropriate technical context and enable the associated advantages to be fully understood. However, any discussion of the prior art throughout the specification should not be considered as an admission that such art is widely known or forms part of the common general knowledge in the field.

Traditional tile laying techniques require a reasonably high level of skill to prepare the surface prior to tiling and to align and consistently space the tiles during installation. While spacing aids are available, they provide additional cost as well as being relatively difficult to use effectively. In addition, traditional tile laying cement can be messy to use, often drying to form visual imperfections on the surface of the tiles. For these reasons, both wall and floor tiling is typically not ideally suited to the do-it-yourself home handyman or renovator.

On solution offered to this problem is the modular system for tiling indoor spaces and paving outdoor spaces disclosed by WO 2005/124053. In this application, a method of assembling modular panels—constituted by a substantially square ground contact frame on top of which is a permanently fixed tile—is described. Each panel further includes male tabs and corresponding female elements arranged alternately along the perimeter of the frame for interconnecting adjacent modular panels. Once assembled, a plurality of interconnected modular panels combine to define a floating tiled floor, which is ready for use immediately.

The system taught by WO 2005/124053, however, is subject to several problems and limitations. Firstly, the panels are heavy and difficult to manipulate during installation. Also, due to the tile being permanently fixed to the ground contact frame, the user is required to select a tile or paver from the stock available through the panel supplier. Consequently, the user has a relatively limited selection when compared to the tiles available on the market.

It is an object of the present invention to overcome or ameliorate at least one of the disadvantages of the prior art, or to provide a useful alternative.

It is an object of a preferred form of the invention to provide a modular flooring system that is relatively easy to install and is able to utilise standard tiles. Ideally, the system will be able to accommodate tiles or pavers from different manufacturers and therefore give the user a greater selection.

DISCLOSURE OF THE INVENTION

According to a first aspect, the invention provides a tile tray including:

a generally planar base;

two or more retaining members adapted to locate and retain a tile to the base; and a coupling means for connecting two or more of the tile trays in a substantially aligned configuration.

In one embodiment, at least one of the retaining members is a movable retaining member. Preferably, the movable retaining member is resiliently movable. More preferably, the tile tray includes two or more resiliently connected portions, the portions including the retaining members.

In one embodiment, the tile tray includes four resiliently connected portions.

In one embodiment, the retaining members protrude from the base.

In one embodiment, each retaining member includes a substantially continuous locating edge. Preferably, the locating edge generally extends from the periphery of the base.

In one embodiment, each retaining member includes a right-angled protrusion adapted to retain a corner of a tile.

In one embodiment, the tile tray has a substantially square shape. Preferably, the base is sized to correspond to standard ceramic, slate, marble tile or paver dimensions. In another embodiment, the tile tray has a substantially triangular shape.

In one embodiment, the tile has a close or even an interference fit with the base.

In one embodiment, the tile tray includes an adhesive means for securing the tile to the base. Preferably, the adhesive means includes one or more adhesive pads disposed on the base, the adhesive pads including a protective liner. More preferably, the adhesive means includes liquid glue, bonding composition, liquid cement, or other type of liquid adhesive. Depending on the type of adhesive means used, the tiles may be releasable from the base. Advantageously, this allows the tiles to be replaced in case of breakage or merely a change of design.

In one embodiment, the coupling means includes a plurality of interlocking formations disposed about the periphery of the tile tray, the interlocking formations being adapted for interlocking engagement with corresponding formations on an adjacent tile tray. Preferably, the interlocking formations are releasably and snap-lockingly engageable.

In one embodiment, the interlocking formations include male locating protrusions and female locating apertures, the female locating apertures being adapted to receive the male locating protrusions. Preferably, the male locating protrusions extend from at least one side of the tile tray and the female locating apertures are disposed along at least one other side of the tile tray. More preferably, the male locating protrusions are disposed on two contiguous sides of the tile tray and the female locating apertures are disposed on the other two contiguous sides of the tile tray. In some embodiments, the interlocking formations are adapted to provide a degree of lateral restraint between adjacent trays when engaged.

In one embodiment, each female locating aperture includes an internal abutment surface for retaining a corresponding male locating protrusion. Preferably, each male locating protrusion includes a substantially tapered leading tip for insertion into the female locating aperture. More preferably, each male locating protrusion includes an abutment surface for retaining the locating protrusion in the female locating aperture.

In one embodiment, the coupling means further includes a spacer bar extending along at least one side of the tile tray substantially adjacent to the female locating apertures, the spacer bar being adapted for abutment with an adjacent tile tray thereby to substantially align the tile tray with respect to the adjacent tile tray. Preferably, the spacer bar includes a first abutment surface for engagement with the male locating protrusions. More preferably, the spacer bar includes a second abutment surface for contacting an adjacent tile tray.

In one embodiment, the base includes a plurality of adhesion apertures, the adhesion apertures being adapted to provide a flow path for a liquid adhesive thereby to better adhere the tile to the tile tray upon setting of the liquid adhesive. Preferably, each aperture includes a rebate peripherally extending around its underside thereby to further assist in adhering the tile to the tile tray upon setting of the liquid adhesive.

In one embodiment, the base includes a textured pattern on its upper surface for assisting in adhering the tile to the tile tray.

In one embodiment, the tile tray is predominantly formed from an injection moulded plastics material. Preferably, the tile tray is predominantly formed from high-density polyethylene.

In one embodiment, the tile tray includes resilient supports for contacting an underlying surface such that slight imperfections in the underlying surface are compensated for.

In one embodiment, the tile tray is installed substantially horizontally. Alternatively, in another embodiment, the tile tray is installed substantially vertically.

A plurality of interconnected trays preferably combines to define a modular floor system, which may be installed with an underlay. Installation of any traditional underfloor services, such as underfloor heating, is also possible.

According to another aspect of the invention, there is provided a method of installing a modular system including a plurality of tile trays according to the first or second aspect, the method including the steps of:

(i) laying a first tile tray on a surface;

(ii) connecting a second tile tray to the first tray such that the coupling means locates the tile trays in an aligned configuration; and (iii) inserting tiles into the tile trays such that the retaining members locates and retains the tiles.

While it is easier to manipulate the tile trays and connect them together when they are empty, it will be appreciated that the step of inserting the tiles into the tile trays may be performed prior to the tile trays being connected together.

In one embodiment, the method further includes the step of applying a grout to the gaps between the tile tiles. Alternatively, a settable rubber based and water resistant clear sealant is applied to the gap region between the tile trays and a moulded 'grout-resembling' resilient plastic profile is placed over the sealant. In this way, the connecting regions of contiguous modular panels are covered to advantageously give the appearance of a traditionally laid grouted tiled surface.

Reference throughout this specification to "one embodiment", "some embodiments" or "an embodiment" means that a particular feature, structure or characteristic described in connection with the embodiment is included in at least one embodiment of the present invention. Thus, appearances of the phrases "in one embodiment", "in some embodiments" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

BRIEF DESCRIPTION OF THE DRAWINGS

Preferred embodiments of the invention will now be described, by way of example only, with reference to the accompanying drawings in which.

PREFERRED EMBODIMENTS OF THE INVENTION

Figure 1:
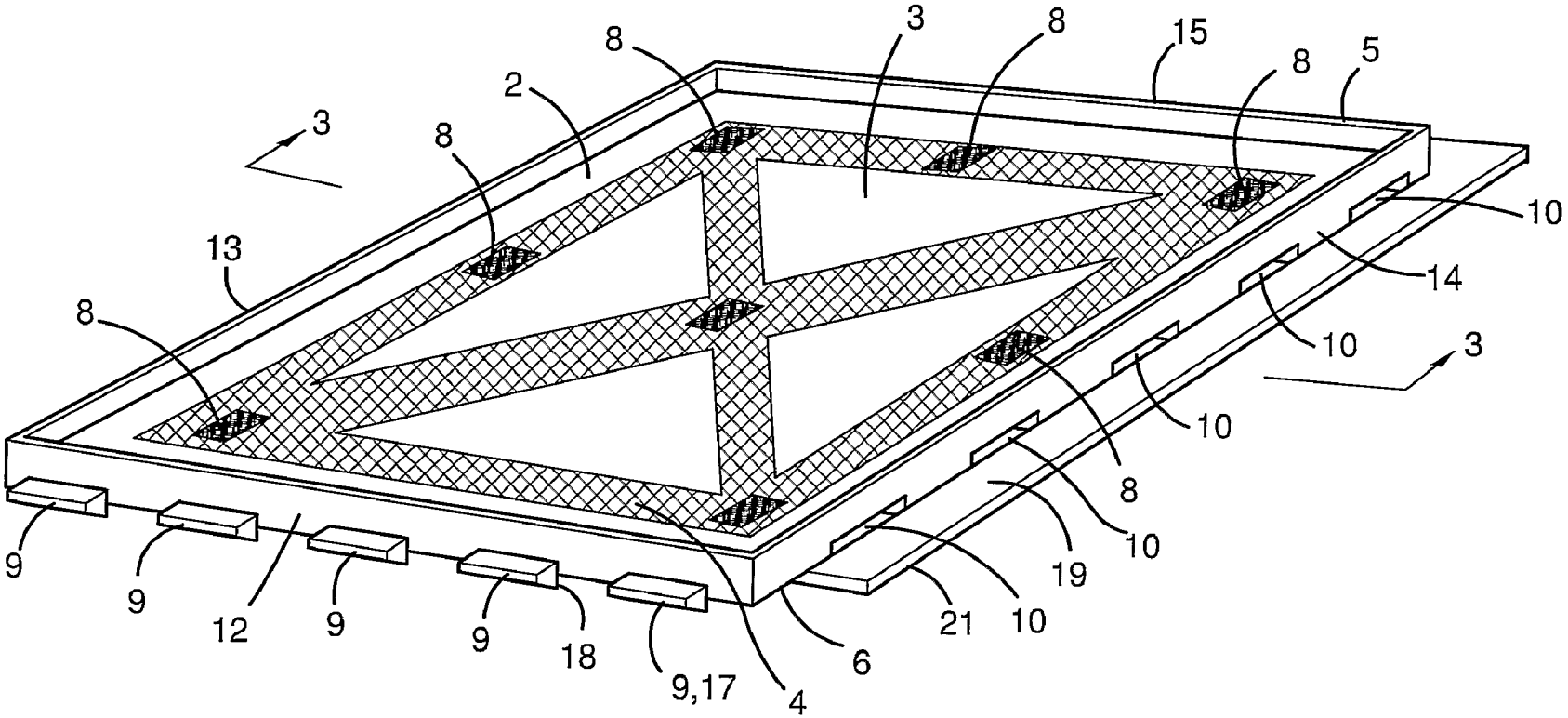
FIG. 1 is a perspective view of a tile tray in accordance with a first embodiment of the invention.
Figure 2:
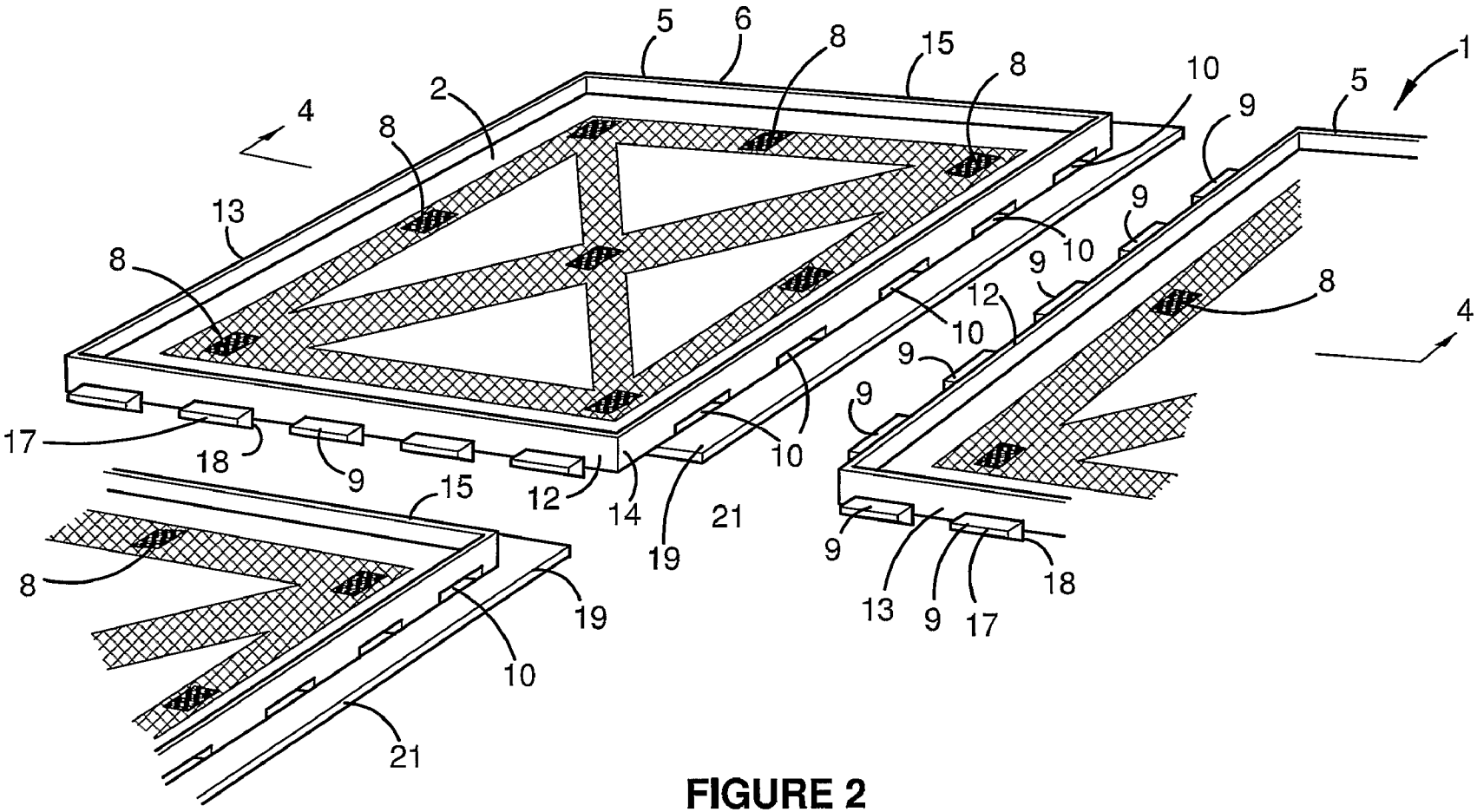
FIG. 2 is a perspective view of the tile tray of FIG. 1 just prior to being connected to two other tile trays.

Referring to the accompanying drawings and initially to FIGS. 1 to 4, there is depicted a tile tray 1 for housing a tile 7 in accordance with the present invention. It is envisaged that a plurality of tile trays be used to house a plurality floor or wall tiles, thereby to define a modular floor or wall system.

The tile tray 1 includes a substantially planar base 2 having a support surface 3 with a textured pattern or surface 4 disposed thereon. In the illustrated embodiment, the textured pattern extends around the periphery of the support surface and in a X-shape across the surface. It will be appreciated, however, that the textured surface may be have other configurations. Moreover, in alternate forms the support surface may additionally include a plurality of adhesion apertures.

The tile tray 1 further includes a continuous locating edge 5 substantially extending from the periphery 6 of the base to define a region, which is generally dimensionally identical to and adapted to receive, a tile. The tile 7 should fit within the confines of the locating edge 5 in a generally close fitting relationship and may, in some preferred forms, have a slight interference fit with the locating edge 5.

In an alternate embodiment (not shown), the locating edge may be replaced by right-angled protrusions extending from the base to retain two or more corners of the tile 7. In a further alternate embodiment (not shown) a plurality of linear protrusions, which generally follow the same path as locating edge 5, are provided to at least partially contact two or more sides of the tile.

In the illustrated embodiment, the tile tray 1 is formed from an engineered plastics material such as injection moulded high-density polyethylene, which will advantageously provide a degree of resilience. Of course, it should be understood that other production methods and materials might be used without departing from the scope of the invention.

An adhesive means including a plurality of adhesive pads 8 disposed on the support surface 3, is also provided to secure the tile to the base. The adhesive pads 8 are exposed for adherence to the tile 7 by peeling back a protective liner (not shown). Alternatively, in other preferred forms, the adhesive means may be in the form of a settable liquid adhesive such liquid glue, bonding composition, cement, or other type of liquid adhesive. Depending on the type of adhesive means used, the tiles may be releasable from the support surface 3 after initial installation. This advantageously allows the tiles to be replaced in case of breakage or merely a change of design preference.

Disposed about the periphery of the tile tray is a coupling means in the form of plurality of interlocking formations for interlocking engagement with corresponding formations of an adjacently disposed tray. The interlocking formations include five male locating protrusions 9 extending from two contiguous sides 12 and 13 of the tile tray, and five corresponding female locating apertures 10 disposed along the other two sides 14 and 15. As can be seen, the locating protrusions are adapted to releasably engage with locating apertures 10 disposed on an adjacent tray.

Figure 3:
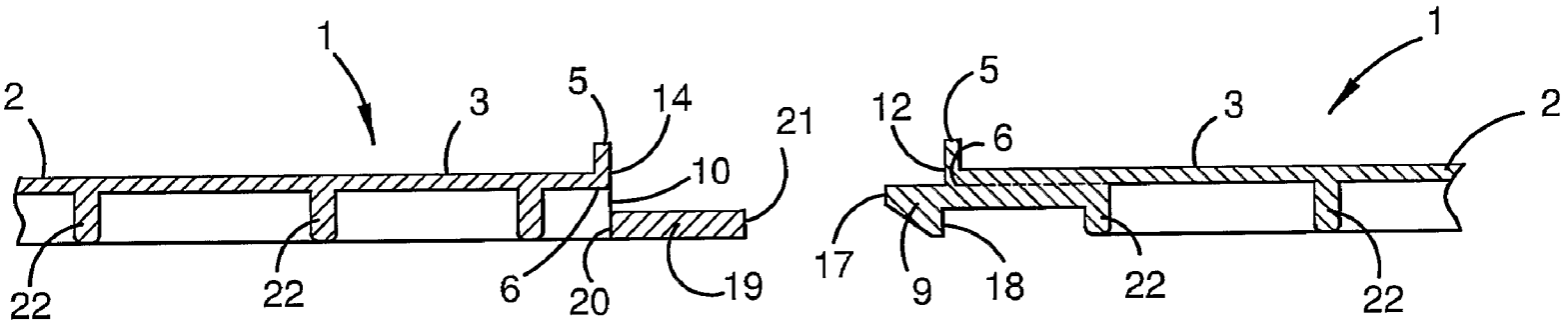
FIG. 3 is a cross-sectional view taken along line 3-3 of FIG. 1.
Figure 4:
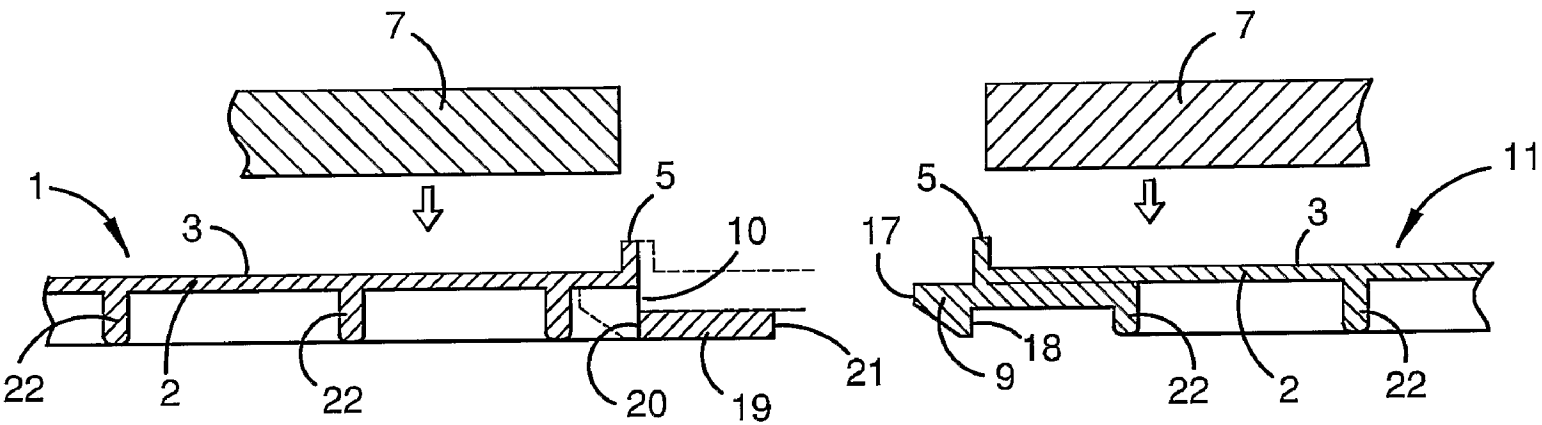
FIG. 4 is a cross-sectional view taken along line 4-4 of FIG. 2.
Figure 5:
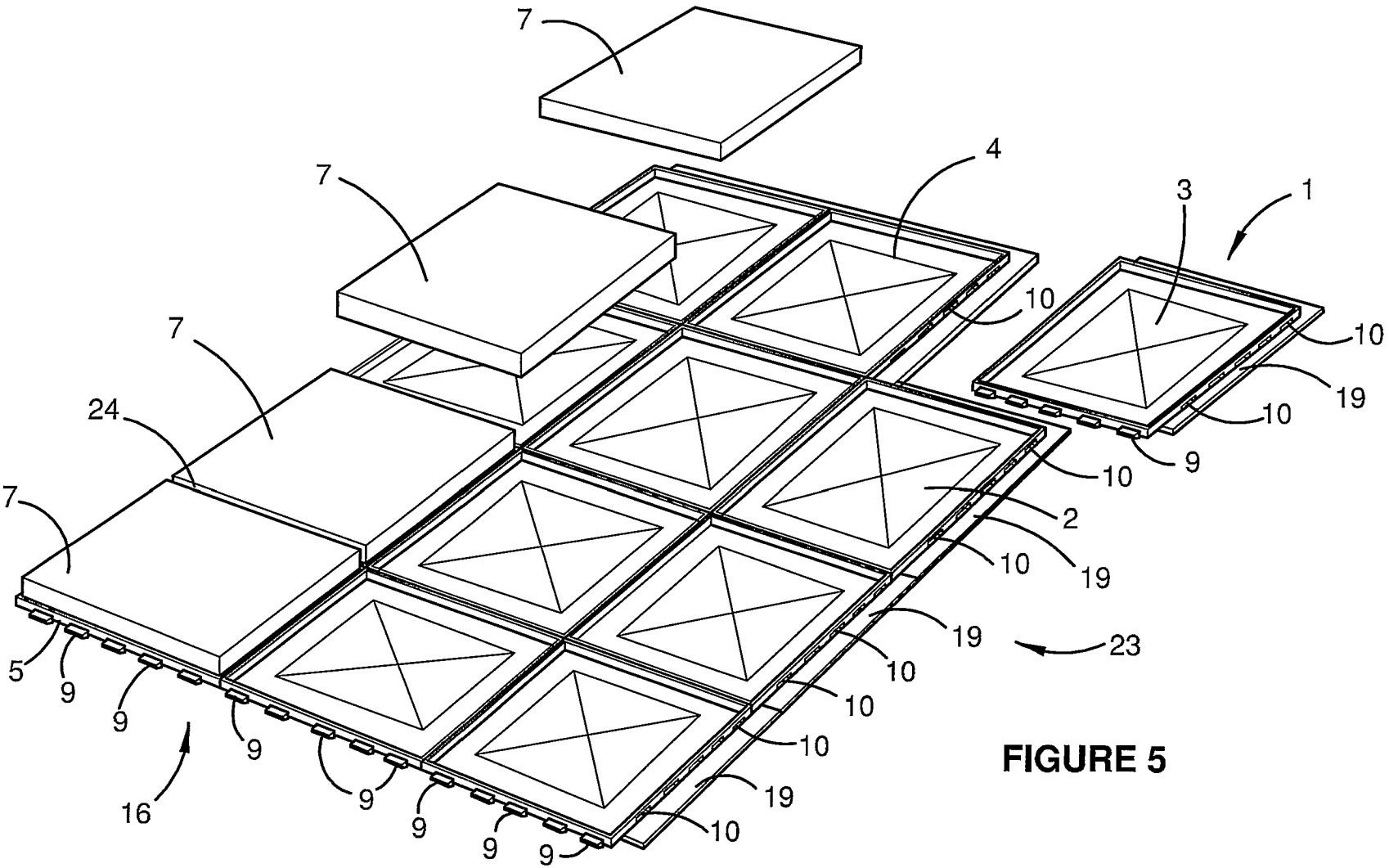
FIG. 5 is a partially assembled view of a modular flooring system including a plurality of interconnected tile trays of FIGS. 1 and 2, shown with tiles being inserted.

As best shown on FIGS. 3 and 4, each locating protrusion 9 includes a tapered leading tip 17 for insertion into a respective locating apertures 10 and an abutment surface 18 for retaining the protrusion in the locating aperture. The arrangement is such that the locating protrusions 9 snap-lockingly engage with the locating apertures 10 to allow a tiled surface 16, as shown of FIGS. 5 and 6, to be built up progressively with each tray accurately aligned with its adjacent tray. Furthermore, it should be understood that according to one feature of the present invention, these interlocking formations are adapted to be releasably engageable, which advantageously allows the tile trays to be removed and reinstalled in a different location, such as when moving house or relocating a commercial premises.

The coupling means further includes a spacer bar 19 extending along edges 14 and 15 of the tile tray 1 The spacer bar has a first abutment surface 20 for the aforementioned snap locking engagement with the surface 18 of the locating protrusions 9 to prevent its release from the aperture 10. The spacer bar 19 also includes a second abutment surface 21 for contacting the base of an adjacent tray thereby to maintain a spaced and aligned relationship between adjacent trays upon assembly. It should be noted that, due to the resilience provided the design of the interlocking formations and their plastic construction, the engagement between the locating protrusions and locating apertures of adjacent trays, also advantageously provide a slight degree of angular compensation between connected trays.

In other not shown embodiments, the locating protrusions 9 and locating apertures 10 are arranged alternately along the perimeter of the base 2. The locating protrusions 9 may also be disposed on mutually opposite sides of the base 2, while the locating apertures 10 are disposed on the two intermediate sides. It will further be appreciated that any number of interlocking formations may be present on each side of the tile tray without departing from the scope of the invention.

As best shown in FIGS. 3 and 4, the tile tray 1 also includes resilient supports 22 for contact with the underlying surface. Advantageously, this and the aforementioned angular and lateral compensation, generally reduce the effect of slight imperfections in the underlying surface.

In this illustrated embodiment, the tile tray has a generally square shape to correspond to standard square ceramic, slate, marble tile or paver tile dimensions. Moreover, it should be understood that it is proposed to manufacture the tile tray to fit all standard sized tiles. Advantageously, the tile tray may be cut using traditional methods to fit irregular sized tiles, for example, tiles that have been cut to fill leftover spaces.

The tile tray can be installed either horizontally or vertically (using an appropriate adhesive) and, where required, can be installed over a sound absorbing underlay. Installation of any traditional underfloor services, such as underfloor heating, is also possible using the tile tray of the present invention. Moreover, as can be appreciated by reference to FIGS. 3 and 4, an air cavity is defined in the underside regions of the tile tray. This air cavity provides a layer of sound absorption to substantially minimise sound transfer between the topside to the underside of the tray once assembled. The air cavity can be also pre-filled with an underlay material or even sound absorbing foam material to further minimise sound transfer and even provide thermal insulation if required.

Figure 8:
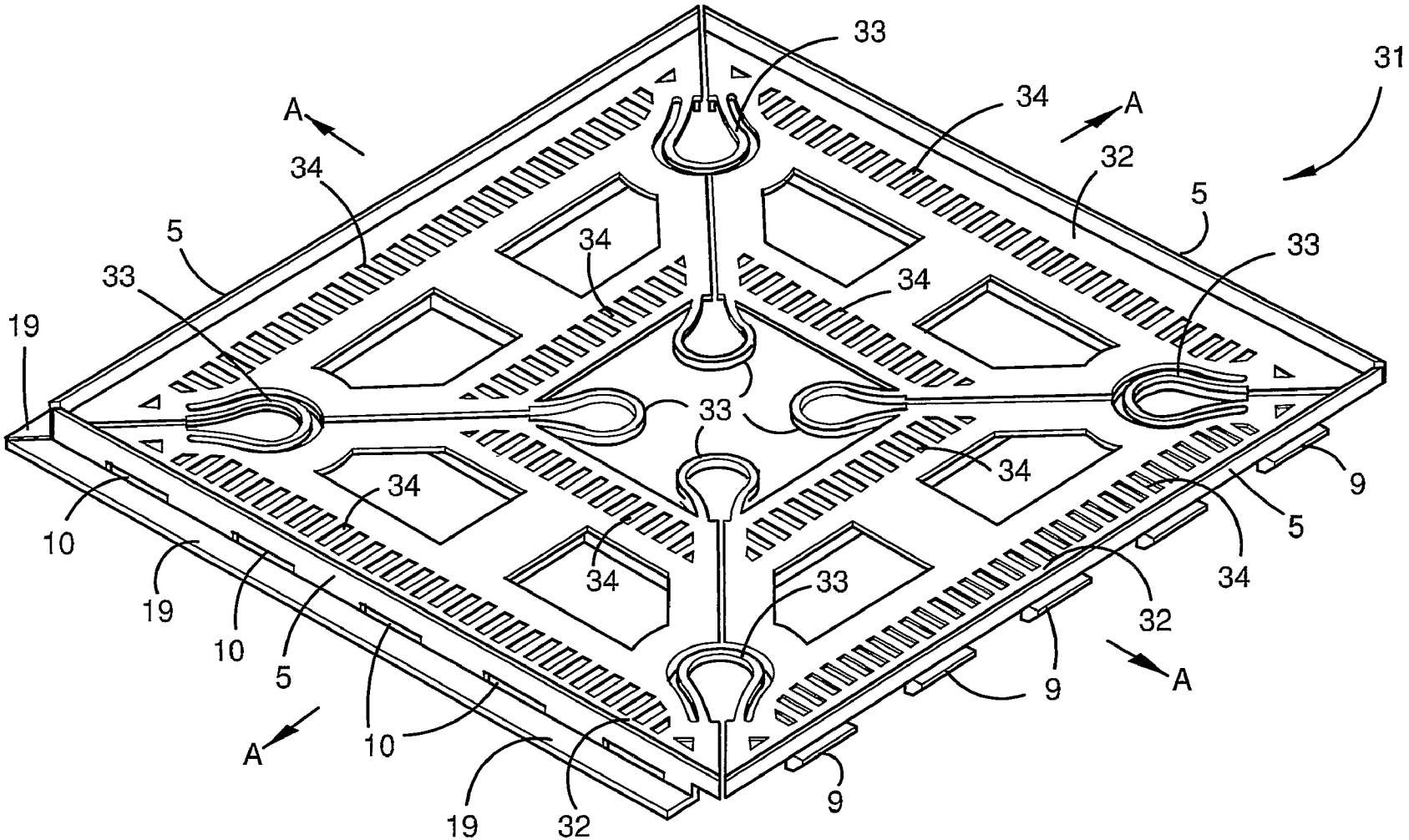
FIG. 8 is a topside perspective view of a tile tray in accordance with another embodiment of the invention.
Figures 9, 9A:
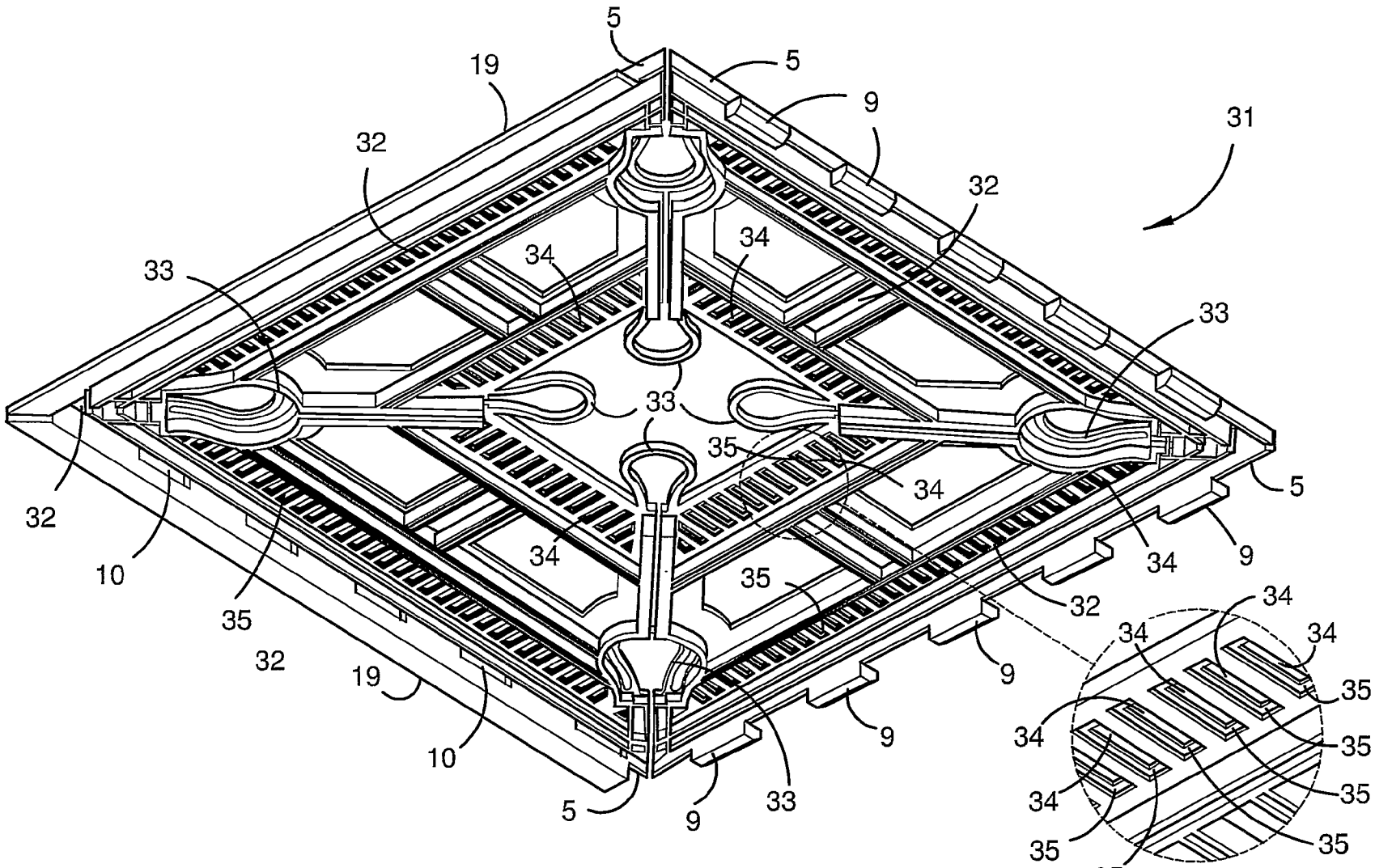
FIG. 9 is an underside perspective view of the tile tray of FIG. 8.
FIG. 9*a* is an enlarged underside perspective of a region of the tile tray of FIG. 9.

Referring to FIGS. 8 to 9*a*, there is depicted a tray 31 in accordance with a further embodiment of the invention. Tray 31 is similar to the tile tray of the first embodiment in that it includes locating edge 5 defining a region or receiving the tile, locating protrusions 9, locating apertures 10, spacer bar 19 and air cavity defined the tile tray's underside. However, in this embodiment, tray 31 is now the form of four resiliently connected portions 32. In particular, each portion 32 is connected to its adjacent portions through outboard and inboard resilient loop members 33. As a result, the portions 32 are now able to move outwardly in the direction A, yet are biased towards the centre of the tile tray.

It will be appreciated that as each portion moves outwardly, one side of the locating edge 5, which acts as a tile retaining member, will also move outwardly. Accordingly, the region defined by the locating edge is now adapted to vary in overall size. In this way, the tile tray 31 is now advantageously able to accommodate tiles of slightly different overall dimensions, which may result from different tile suppliers and/or manufacturing methods. It should be understood that, in the same way as the first embodiment, the locating protrusions 9, locating apertures 10 and spacer bar 19 of adjacently laid tiles cooperate to snap-lockingly engage to allow a tiled surface to be built up progressively with each tray accurately aligned with its adjacent tray.

It is also proposed to form this illustrated embodiment in the same way as the first embodiment, that is, from an injection moulded resilient plastics material. Advantageously, this material will provide the pre-requisite resilience for both the outboard and inboard resilient loop members 33.

Skilled persons in the art will appreciate that since most floor or wall tiles are formed from generally porous materials, a liquid adhesive is able to penetrate the tile's underside surface to create a strong bond. However, since it is proposed to form the tile trays 1 and 31 of the present invention from a plastic 'non-porous' material, bonding between the tile tray and a liquid adhesive may not be necessarily ideal.

In order to address this concern there is provided a plurality of adhesion apertures 34, which is a further advantageous feature of the present invention. These adhesion apertures advantageously provide a fluid path for a liquid adhesive to flow through thereby to better adhere the tile tray to the tile upon solidification of the adhesive. It should be noted that these adhesion apertures are not limited to the embodiment depicted on FIGS. 8-9*a*, and may be included with any embodiment of the present invention and may replace or even supplement the textured pattern 4.

Also, as best shown in FIGS. 9 and 9*a*, to further enhance the bond strength of a liquid adhesive, each aperture includes a peripherally extending rebate 35 disposed on its underside. It has been found that these rebates will fill with the liquid adhesive during assembly, which in turn will retain the liquid adhesive to the tile tray more positively when in a solid or 'dry' state. In addition, in some applications where the completed tiled surface is desired to be more permanent, the liquid adhesive may flow through each aperture 34 and drip through to and adhere the tile tray to the underlying surface.

Figure 10:
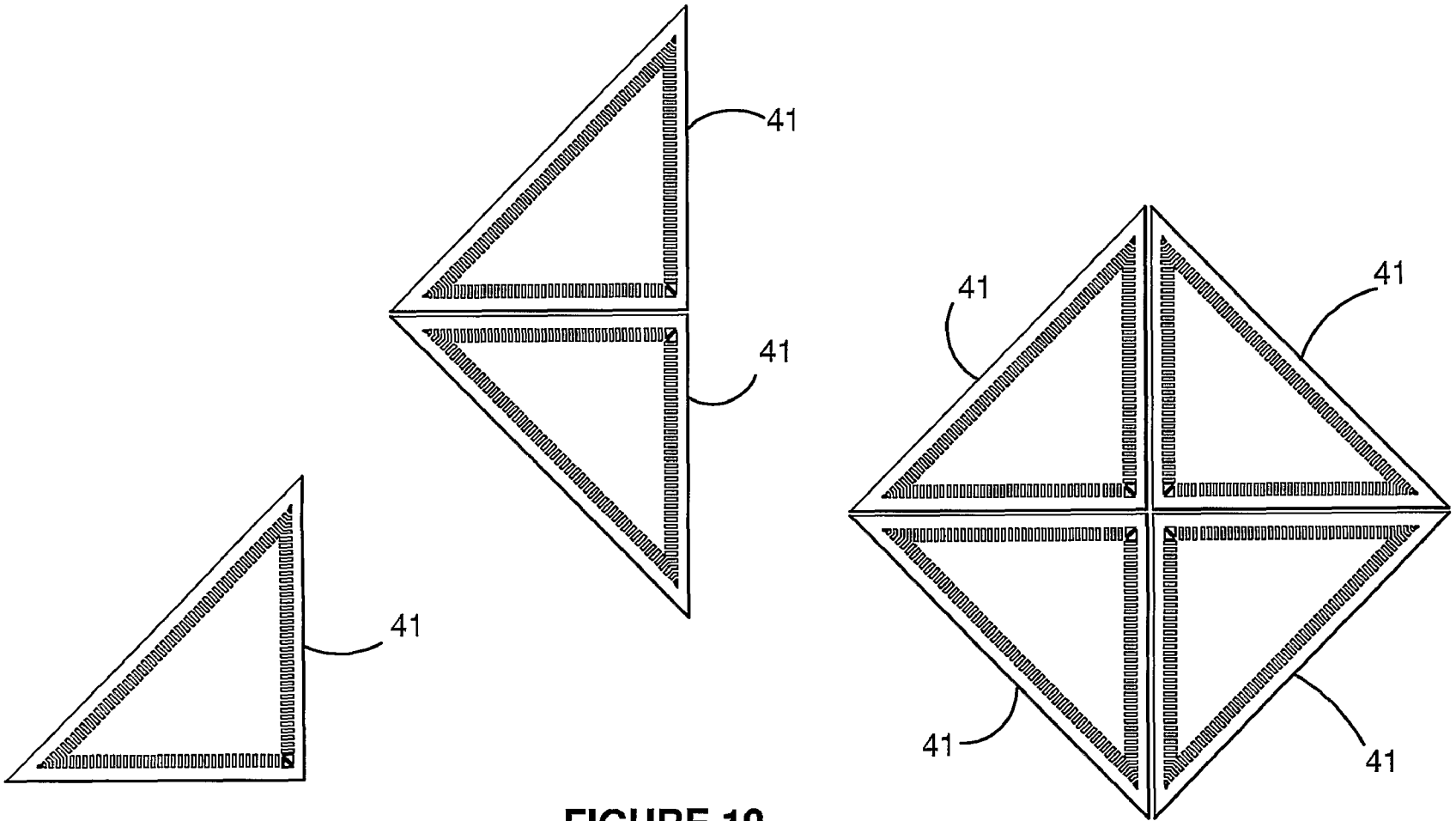
FIG. 10 is a schematic plan view of a tray in accordance with another embodiment of the invention.
Figure 11:
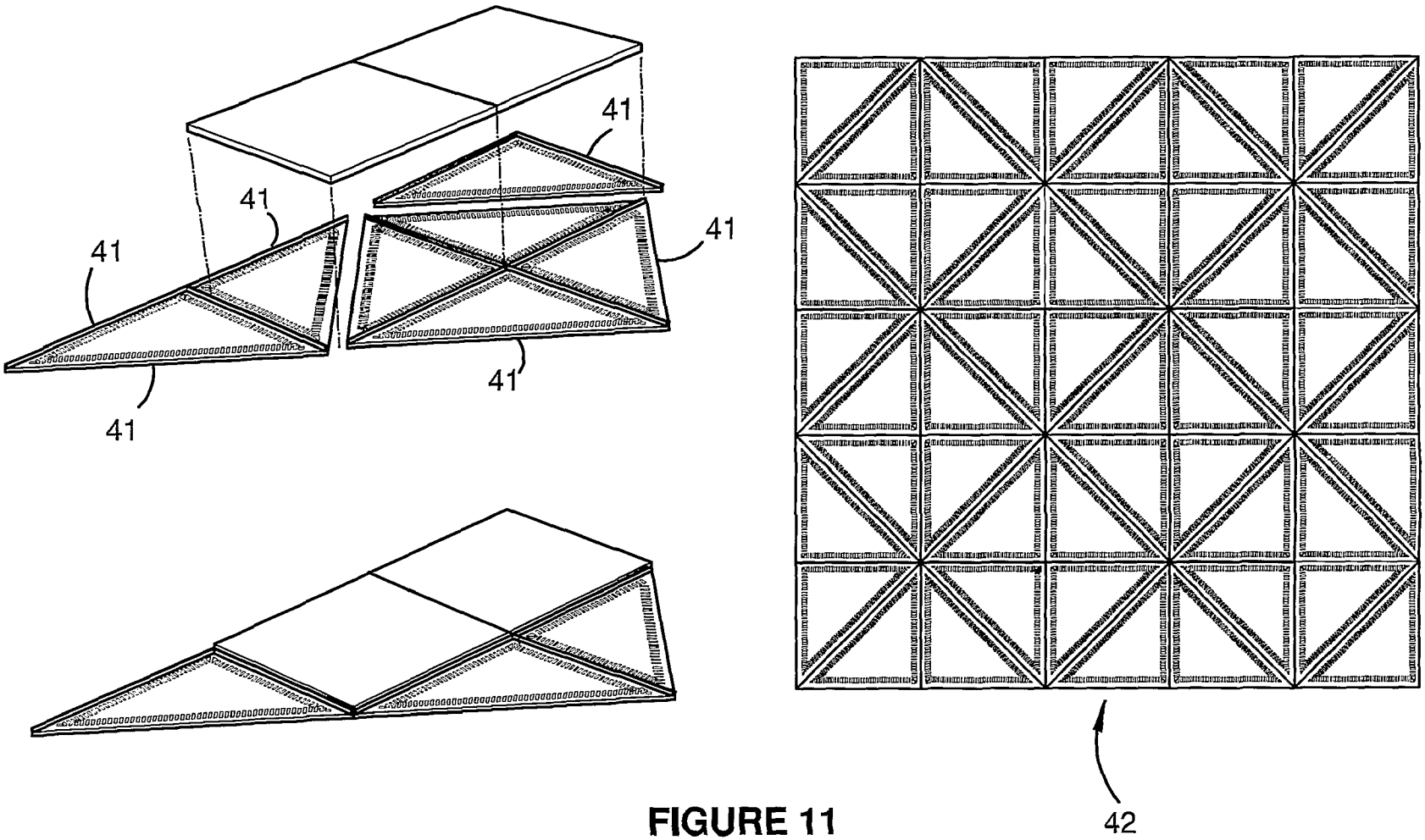
FIG. 11 is a partially assembled perspective view of the embodiment of FIG. 10.

Referring to FIGS. 10 and 11, there is depicted tray 41 in accordance with yet a further embodiment of the invention. Tile tray 41 is similar to the tile trays of the above embodiments in that it includes adhesion apertures 34, locating edge 5, locating protrusions 9, locating apertures 10 and spacer bar 19 (not shown in these schematic views). However, in this embodiment the tile tray now has a triangular shape of approximately one half or one quarter of a standard tray size. Those skilled in the art would appreciate how such shapes can be used to make up a different pattern 42 utilising interconnected triangular tile tray assemblies such as those depicted in FIG. 11.

Returning now to FIGS. 5 and 6, to assemble, the trays are progressively laid onto the underlying surface in an adjacent formation, ideally starting from a wall or other aligning feature (not shown). The locating protrusions 9 and locating apertures 10 are lined up and the tile trays manipulated to allow the protrusions to each engage a respective aperture and, as a result, the laid trays will move into ideal respective alignment.

Peeling back the protective liners then exposes adhesive pads 8 to allow the tiles 7 to be inserted into the tile trays after a number of trays have been assembled. Alternatively, a liquid adhesive is applied directly to either the underside of the tile or to the textured surface 4 and/or the adhesion apertures 34. Advantageously, the tile trays are easier to manipulate and connect together when they are empty, however, it should be noted that the tiles could be inserted into the tile trays 1, 31, 41 at any time during the assembly process.

The process continues until the tile tray/tile assemblies cover the desired surface.

Subsequently, what gaps remain are covered by partial sized trays and tiles, either cut on site or supplied in quarter or half sizes.

Figure 6:
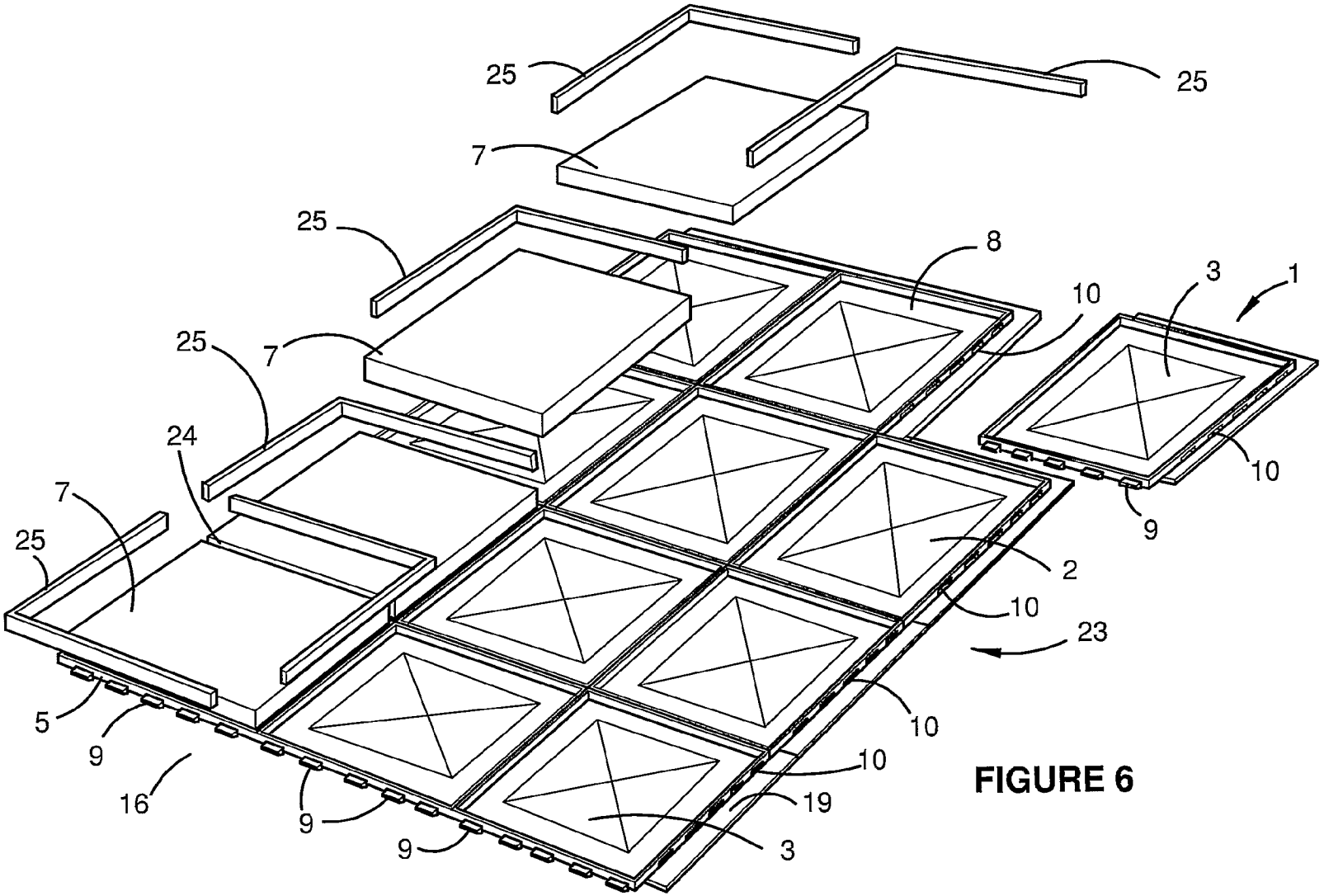
FIG. 6 is a view similar to FIG. 5 showing "L" shaped grout-resembling profiles being applied to the gaps between the tiles.
Figure 7:
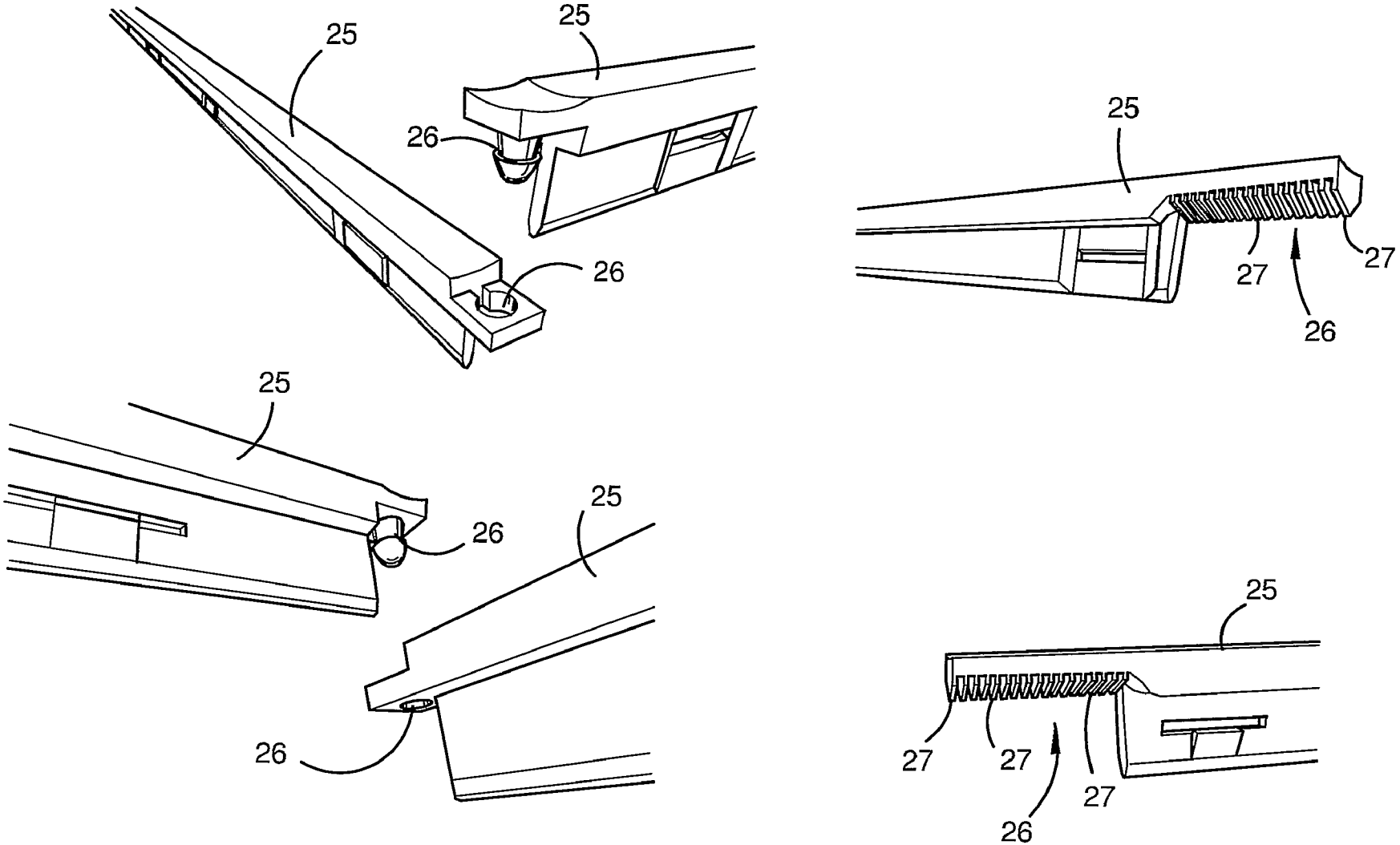
FIG. 7 shows several different views of single strip grout-resembling profile.

The assembly procedure may also include the extra step of applying a grout (not shown) to the gaps 24 between the assembled trays. Alternatively, and as best shown in FIGS. 6 and 7, a settable rubber based and water resistant clear sealant is applied to the gaps 24 and a moulded grout-resembling resilient plastic profile 25 is placed over the clear sealant. In this way, the connecting regions of connected trays are covered to advantageously give the appearance of a traditionally laid grouted tiled surface.

As can be seen in FIG. 6, the profiles 25 may in the form of "L" shaped sections, which cover two contiguous sides of a square tray. Alternatively, as shown in FIG. 7, the profiles may be the form of single strip profiles 25, which connect at each corner using snap lock fasteners 26. Advantageously, each profile 25 is trimmed to shape to fit the tile tray's side length and for this reason, may include indicia to indicate length or, alternatively, a rack region 26 having teeth 27 each of which corresponds to one discrete length.

Once laid with the tiles adhered in place, a 'floating' tiled floor is defined. A floating floor is advantageous because it is free to float above the underlying surface it or subfloor) and is therefore able expand and contract with changes in humidity and temperature. As a result, a floating floor is hard wearing and develops minimal gaps during use. Also, in the present case the tiles trays can be disassembled and relocated to another location if required saving the consumer significant costs.

It will be appreciated that the tile trays of the illustrated embodiments advantageously combine provide a modular flooring system that is relatively easy to install because exact alignment between the adjacent components occurs automatically upon assembly. Advantageously, the tile trays and tiles are provided separately allowing easier manipulation of the tile trays during assembly and a wider selection of tile choice.

Furthermore, the tile trays can be easily pushed together and assembly may only require a single tool to cut any tiles 7 or profiles 25 if required. Consequently, skilled labour is not required for assembly and therefore this system is particularly suited to "do-it-yourself" home renovators and/or builders. Ideally, the components are formed from standard materials, which are well suited to high-speed automated manufacture and, accordingly, would be relatively inexpensive to manufacture and therefore inexpensive for the end user to purchase.

It will be further appreciated that the above-mentioned aligned configuration could include any predetermined respective angular configuration as desired.

Although the invention has been described with reference to specific examples, it will be appreciated by those skilled in the art that the invention may be embodied in many other forms. In particular, it should be appreciated that the bases, retaining protrusions, locating apertures and locating protrusions may take a variety of shapes and configurations, other than those specifically illustrated.

The claims defining the invention are as follows:

1. A tile tray including:

a base having two or more generally planar portions, said portions being resiliently interconnected so as to provide resilient lateral movement with respect to one another;

two or more retaining members generally extending from the periphery of said portions, for locating a tile with respect to said base; and a coupling means for connecting two or more of said tile trays in a substantially aligned configuration.

2. A tile tray according to claim 1, including four resiliently connected portions.

3. A tile tray according to claim 1, wherein said retaining members protrude from said base.

4. A tile tray according to claim 1, wherein each retaining member includes a substantially continuous locating edge.

5. A tile tray according to claim 4, wherein said locating edge generally extends from the periphery of said base.

6. A tile tray according to claim 1, wherein each retaining member includes a right-angled protrusion adapted to retain a corner of a tile.

7. A tile tray according to claim 1, wherein said base is substantially square.

8. A tile tray according to claim 1, including an adhesive means for securing said tile to said base.

9. A tile tray according to claim 8, wherein said adhesive means includes one or more adhesive pads disposed on said base, said adhesive pads including a protective liner.

10. A tile tray according to claim 8, wherein said adhesive means includes liquid glue, bonding composition, liquid cement, or other type of liquid adhesive.

11. A tile tray according to claim 1, wherein said coupling means includes a plurality of interlocking formations disposed about the periphery of said tile tray, said interlocking formations being adapted for interlocking engagement with corresponding formations on an adjacent tile tray.

12. A tile tray according to claim 1, wherein said interlocking formations are releasably and snap-lockingly engageable.

13. A tile tray according to claim 11, wherein said interlocking formations include male locating protrusions and female locating apertures, said female locating apertures being adapted to receive said male locating protrusions.

14. A tile tray according to claim 13, wherein said male locating protrusions extend from at least one side of said tile tray and said female locating apertures are disposed along at least one other side of said tile tray.

15. A tile tray according to claim 13, wherein said male locating protrusions are disposed on two contiguous sides of said tile tray and said female locating apertures are disposed on the other two contiguous sides of said tile tray.

16. A tile tray according to claim 13, wherein each female locating aperture includes an internal abutment surface for retaining a corresponding male locating protrusion.

17. A tile tray according to claim 13, wherein each male locating protrusion includes a substantially tapered leading tip for insertion into said female locating aperture.

18. A tile tray according to claim 13, wherein each male locating protrusion includes an abutment surface for retaining said locating protrusion in said female locating aperture.

19. A tile tray according to claim 13, wherein said coupling means further includes a spacer bar extending along at least one side of the tile tray substantially adjacent to said female locating apertures, said spacer bar being adapted for abutment with an adjacent tile tray thereby to substantially align said tile tray with respect to said adjacent tile tray.

20. A tile tray according to claim 19, wherein said spacer bar includes a first abutment surface for engagement with said male locating protrusions.

21. A tile tray according to claim 19, wherein said spacer bar includes a second abutment surface for contacting an adjacent tile tray thereby to substantially maintain alignment between two tile trays.

22. A tile tray according to claim 1, wherein said base includes a plurality of adhesion apertures, said adhesion apertures being adapted to provide a flow path for a liquid adhesive thereby to better adhere said tile to said tile tray upon setting of said liquid adhesive.

23. A tile tray according to claim 22, wherein each aperture includes a rebate peripherally extending around its underside thereby to further assist in adhering said tile to said tile tray upon setting of said liquid adhesive.

24. A tile tray according to claim 1, wherein said base includes a textured pattern on its upper surface for assisting in adhering said tile to said tile tray.

25. A tile tray according to claim 1, wherein said tile tray is predominantly formed from an injection moulded plastics material.

26. A tile tray according to claim 1, wherein said tile tray is predominantly formed from high-density polyethylene.

27. A tile tray according to claim 1, including resilient supports for contacting an underlying surface such that slight imperfections in the underlying surface are compensated for.

* * * * *